US009613763B2

(12) United States Patent
Weister

(10) Patent No.: US 9,613,763 B2
(45) Date of Patent: Apr. 4, 2017

(54) CIRCUIT BREAKERS WITH SECONDARY DISPLACEMENT SPRINGS

(71) Applicant: Eaton Corporation, Cleveland, OH (US)

(72) Inventor: Nathan James Weister, Moon Township, PA (US)

(73) Assignee: Eaton Corporation, Cleveland, OH (US)

( * ) Notice: Subject to any disclaimer, the term of this patent is extended or adjusted under 35 U.S.C. 154(b) by 268 days.

(21) Appl. No.: 14/452,888

(22) Filed: Aug. 6, 2014

(65) Prior Publication Data

US 2016/0042882 A1 Feb. 11, 2016

(51) Int. Cl.

| | |
|---|---|
| ***H01H 1/50*** | (2006.01) |
| ***H01H 1/14*** | (2006.01) |
| ***H01R 12/71*** | (2011.01) |
| *H01H 71/02* | (2006.01) |

(52) U.S. Cl.

CPC ..... *H01H 1/50* (2013.01); *H01H 1/14* (2013.01); *H01R 12/714* (2013.01); *H01H 71/0207* (2013.01); *H01H 2235/02* (2013.01)

(58) Field of Classification Search

CPC ..... H01H 1/50; H01H 1/14; H01H 2235/02; H01H 71/0207; H01R 12/714

USPC ..... 200/250, 237, 282, 283, 290, 516; 361/634; 439/862, 839

See application file for complete search history.

(56) References Cited

U.S. PATENT DOCUMENTS

| | | | | |
|---|---|---|---|---|
| 4,476,400 | A * | 10/1984 | Jo | G01R 1/206 307/147 |
| 6,705,813 | B2 | 3/2004 | Schwab | |
| 7,466,154 | B2 | 12/2008 | Brodsky | |
| 2013/0035006 | A1 * | 2/2013 | Park | H01R 12/714 439/862 |

OTHER PUBLICATIONS

Shirakawa et al., Synthesis of Electrically Conducting Organic Polymers: Halogen Derivatives of Polyacetylene, (CH)x, J.C.S. Chem. Comm., 1977, pp. 578-580.

* cited by examiner

*Primary Examiner* — Felix O Figueroa
*Assistant Examiner* — Lheiren Mae A Caroc
(74) *Attorney, Agent, or Firm* — Myers Bigel, P.A.

(57) ABSTRACT

Circuit breakers with a first bus energizing spring held in the housing that electrically connects the circuit board to an external electrical connection. The bus primary energizing spring is configured to deflect toward the circuit board with a first linear displacement. The circuit breakers also include a second bus energizing spring held in the housing that is configured to deflect toward the circuit board with a second linear displacement that supplements the first linear displacement.

19 Claims, 9 Drawing Sheets

CIRCUIT BREAKERS WITH SECONDARY DISPLACEMENT SPRINGS

FIELD OF THE INVENTION

The present invention relates to circuit breakers.

BACKGROUND OF THE INVENTION

A brass bus part is typically used to make an electrical connection with a circuit board in a circuit breaker. The bus part is typically in a spring geometry (a bus spring) to absorb assembly variation and apply a contact force ensuring the circuit board is energized. It is typically desirable to maintain a minimum load at all times to facilitate proper electrical connection. FIG. 1 illustrates an example of a prior art energizing or "bus" spring 10. However, over compression of the bus spring, typically a brass sheet metal component, can cause the spring to "set" into shape (lose its resilience) and/or the spring may fatigue over time, either of which can cause the contact force to drop below acceptable limits.

SUMMARY OF EMBODIMENTS OF THE INVENTION

Embodiments of the invention are directed to improved bus spring assemblies and/or designs that can provide sufficient contact force between an electrical (power/input) source and circuit board and/or avoid undue loss in contact force over time.

Embodiments of the invention are directed to circuit breakers that include a housing, a circuit board in the housing, and a first bus energizing spring held in the housing that electrically connects the circuit board to an external electrical connection. The bus primary energizing spring is configured to deflect toward the circuit board with a first linear displacement. The circuit breakers also include a second bus energizing spring held in the housing in cooperating alignment with the first bus energizing spring that is configured to deflect toward the circuit board with a second linear displacement to provide a linear displacement capability that is a summation of the first and second linear displacements.

The second linear displacement can be less than the first linear displacement.

The second bus energizing spring can have an unloaded configuration and a loaded fully compressed configuration. When in the loaded, fully compressed configuration, the second bus energizing spring can have a substantially flat configuration.

The second linear displacement can be a controlled displacement so that the second spring ceases deflection at a flat state whereby the second spring cannot be over stressed.

The second bus energizing spring can be integral to the first bus energizing spring.

The second bus energizing spring can be a discrete component separate from the first bus energizing spring.

The first bus energizing spring can have an elongate segment that resides adjacent and spaced apart from an arm. The elongate segment can have a first planar segment that merges into a second planar segment. The second planar segment can define a circuit board contact surface that contacts the circuit board. The first planar segment can include, hold or be in aligned contact with the second bus energizing spring.

The first bus energizing spring can have an elongate segment and an arm that resides adjacent and spaced apart from the elongate segment. The elongate segment can have a first planar segment that merges into a second planar segment. The second planar segment can define a circuit board contact surface that contacts the circuit board. The second bus energizing spring can have at least one tab that extends above the first planar segment in an unloaded configuration and can be substantially flat and coplanar with the first planar segment in a fully compressed configuration, typically as held in the housing.

The second energizing spring can have a sleeve with a plurality of spaced apart tabs that deflect into respective receiving apertures. The sleeve can be held on the first planar segment.

The first planar segment can have a single tab with a free end surrounded on three sides by a gap space that defines the second bus energizing spring.

The housing can have a first housing member and a second housing member that attach together. The second housing member can hold the circuit board. The second bus energizing spring can reside adjacent the first housing member in abutting contact with the first bus energizing spring and can electrically connect the first bus energizing spring to the external electrical connection.

The housing can include a first housing member and a second housing member that attach together. The second housing member can hold the circuit board. The second bus energizing spring can reside adjacent the first housing member and can be integral to the bus first energizing spring.

The housing can include a first housing member and a second housing member that attach together. The second housing member can hold the circuit board. The second bus energizing spring can reside adjacent the first housing member and can compress to a (maximum) flat configuration due to contact with the first housing member when the first and second housing members are attached.

The second energizing spring can be in abutting contact with the first bus energizing spring and can electrically connect the first bus energizing spring to the external electrical connection.

Other embodiments are directed to a device with a circuit that includes a housing with a first housing member attached to a second housing member, a circuit board in the housing and a first energizing spring held in the housing that electrically connects the circuit board to an external electrical connection. The first energizing spring can be configured to deflect toward the circuit board. The first energizing spring can have an elongate segment and an arm that resides adjacent and spaced apart from the elongate segment. The elongate segment can have a first planar segment that merges into a second planar segment. The second planar segment can reside against the circuit board. The circuit also includes a second energizing spring held in the housing. The second energizing spring extends above the first planar segment in an unloaded configuration and is substantially flat and coplanar with the first planar segment in a fully compressed configuration.

The first energizing spring can be configured to deflect toward the circuit board with a first linear displacement and the second energizing spring can be configured to deflect toward the circuit board with a second linear displacement that is less than the first linear displacement.

Still other embodiments are directed to energizing springs for a circuit (typically a circuit of a circuit breaker). The springs include a first conductive energizing spring comprising an elongate segment and an arm. The elongate segment and the arm reside adjacent and spaced apart from each other. The elongate segment has an upper planar segment that merges into a lower planar segment. The energizing springs also include a second conductive energizing spring that contacts the planar upper surface of or that is formed in the planar upper surface that is configured to deflect downward to a substantially flat configuration upon full compression.

The first conductive energizing spring can include a back segment holding the arm and elongate segment. The arm and elongate segment can extend orthogonal from the back segment.

The first conductive energizing spring can be a monolithic shaped metallic body and the second conductive energizing spring can be formed in the planar upper segment as at least one projecting tab that can deflect down to the substantially flat configuration to be coplanar with the planar upper segment.

The second conductive energizing spring can be attached to the planar upper segment.

Further features, advantages and details of the present invention will be appreciated by those of ordinary skill in the art from a reading of the figures and the detailed description of the preferred embodiments that follow, such description being merely illustrative of the present invention.

It is noted that aspects of the invention described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

DETAILED DESCRIPTION OF EMBODIMENTS OF THE INVENTION

Figure 1:
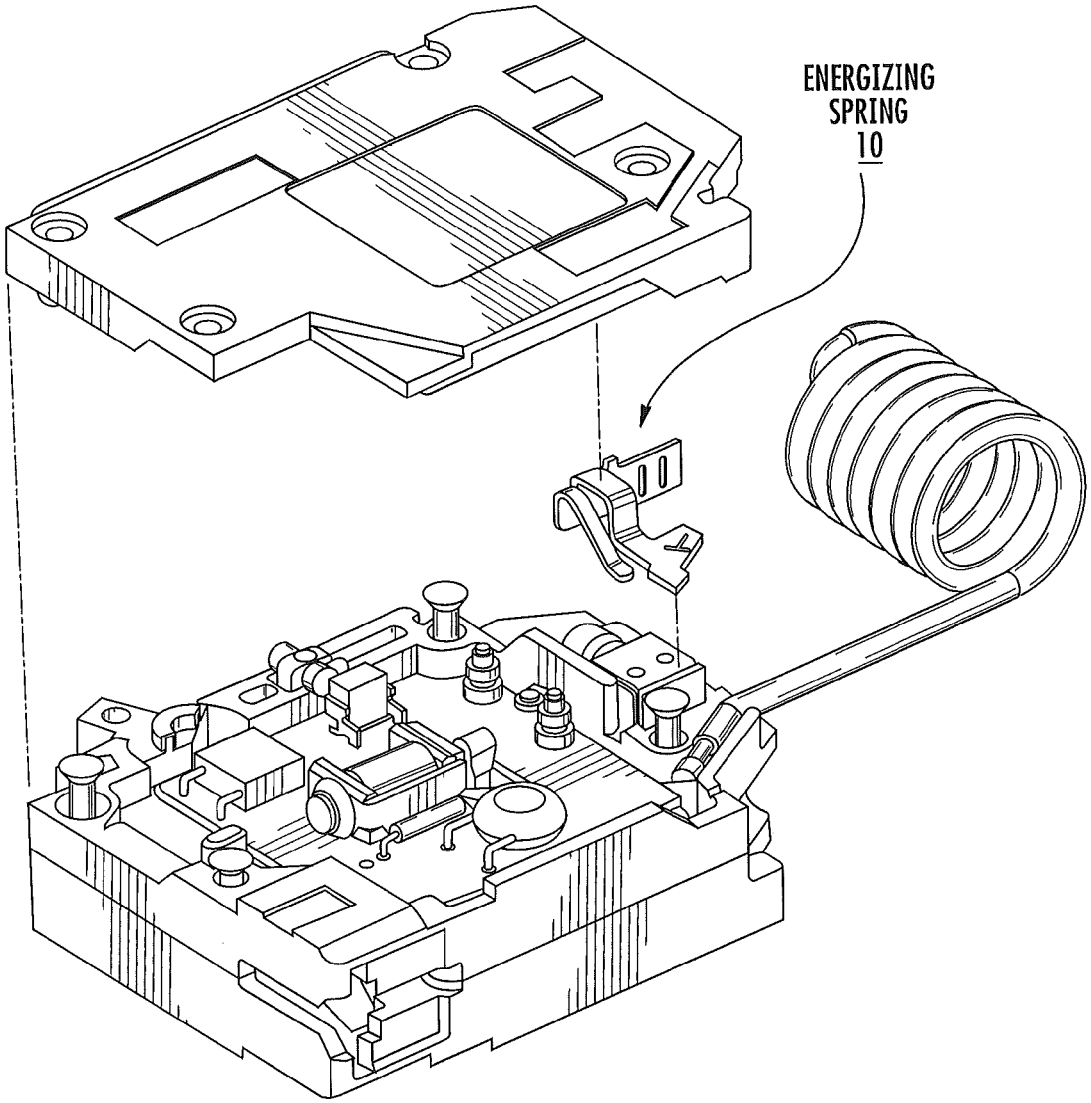
FIG. 1 PRIOR ART
FIG. 1 is an exploded perspective view of a circuit breaker with a prior art energizing or "bus" spring.

The present invention now will be described more fully hereinafter with reference to the accompanying drawings, in which illustrative embodiments of the invention are shown. Like numbers refer to like elements and different embodiments of like elements can be designated using a different number of superscript indicator apostrophes (e.g., 10, 10', 10", 10''').

In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The term "upper" can encompass both an orientation of above and below a component or feature described relative thereto as "lower." The device may be otherwise oriented (rotated 90° or at other orientations) and the spatially relative descriptors used herein interpreted accordingly. The term "about" refers to numbers in a range of +/−20% of the noted value.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

The term "printed circuit board" refers to a substrate with electrical paths and components thereon, typically a rigid or semi-rigid substrate. The term "semi-rigid" refers to substrates that flex upon normal loading.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

Figure 2:
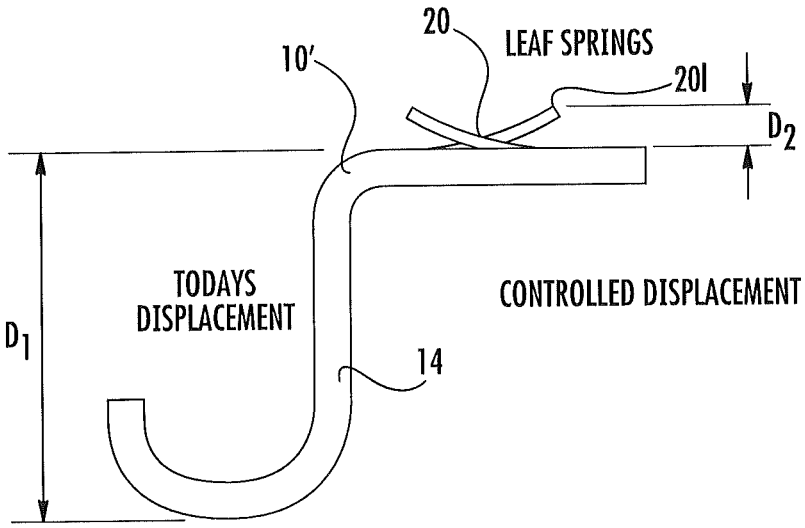
FIG. 2 is a schematic illustration of a bus spring with integrated or additional second spring geometry and/or spring that can flex to provide additional displacement over conventional displacement to maintain a desired contact force over time according to embodiments of the present invention.
Figures 8, 9:
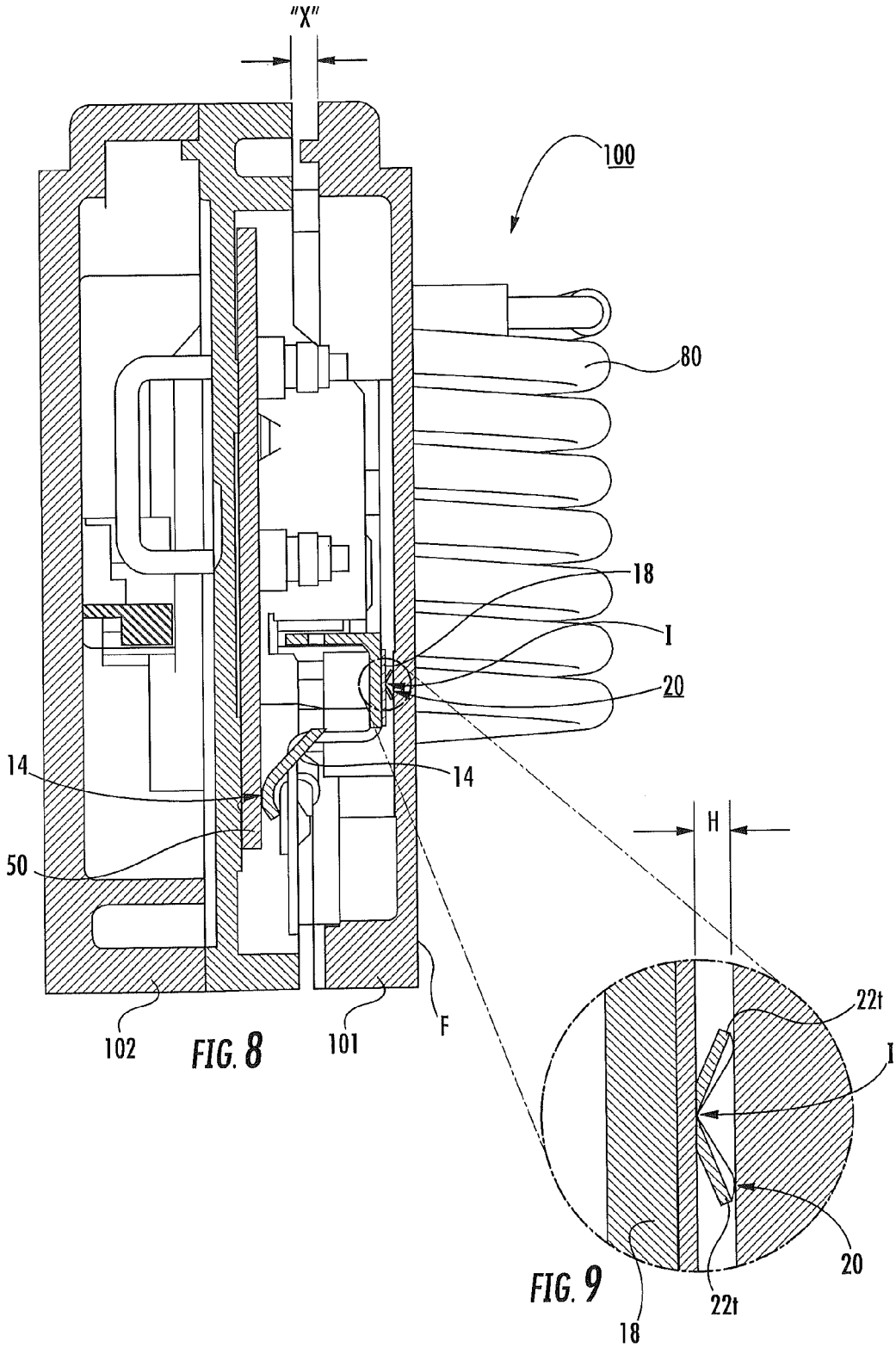
FIG. 8 is an enlarged section view taken along line 8-8 in FIG. 7 according to embodiments of the present invention.
FIG. 9 is an enlarged view of Detail A shown in FIG. 8 according to embodiments of the present invention.

Turning now to the figures, FIG. 2 schematically illustrates displacements $D_1$ and $D_2$ provided by a first energizing spring 10 with at least second energizing spring 20 according to some embodiments of the present invention. The amount of linear distance that the first energizing spring 10 and second energizing spring 20 are compressed is termed "displacement." $D_1$ can correspond to the displacement provided by a respective conventional bus spring 10 (FIG. 1). $D_2$ is the additional displacement (deflection) that can be generated by a second energizing spring 20 under a load placed thereon, e.g., upon assembly in the circuit breaker housing 100*h* (FIGS. 8, 9).

Although $D_2$ is shown as less than $D_1$ with the first energizing spring 10 being a primary energizing spring and the second energizing spring 20 being a secondary energizing spring, other configurations may be used. For example, the second energizing spring 20 may be configured to have a linear displacement $D_2$ that is about the same as the linear displacement $D_1$ of the first energizing spring 10.

To ensure proper electrical engagement, there is a lower displacement limit which is determined by a minimum force that is acceptable. There is also an upper displacement limit which is determined by spring stress levels that is acceptable. A varying amount of displacement can be dictated or consumed by component and assembly variation. Therefore, different circuit breakers with the same layout and components can have different displacements. It is desirable to have sufficient displacement after assembly to prevent fatigue set-in over a defined life span/endurance test.

Figure 3:
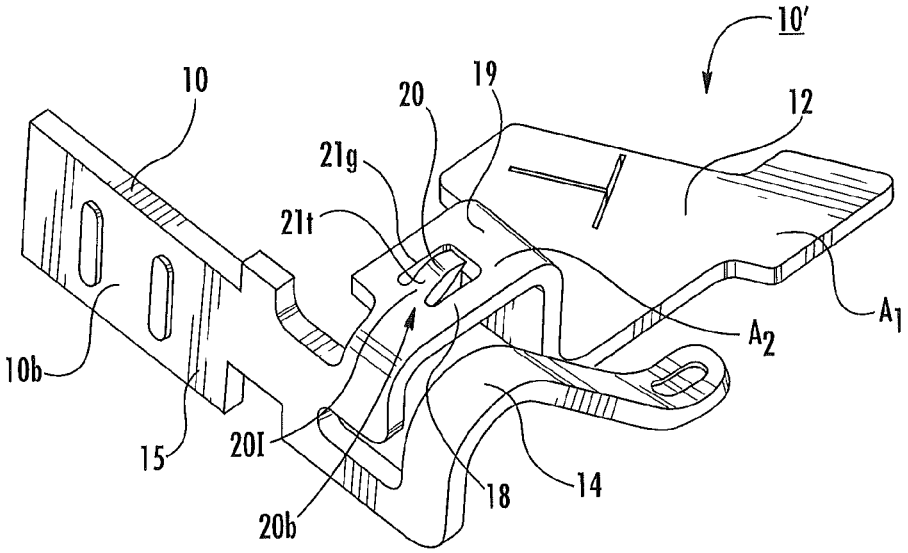
FIG. 3 is an enlarged side perspective view of an example of a new bus spring configuration according to embodiments of the present invention.
Figure 4:
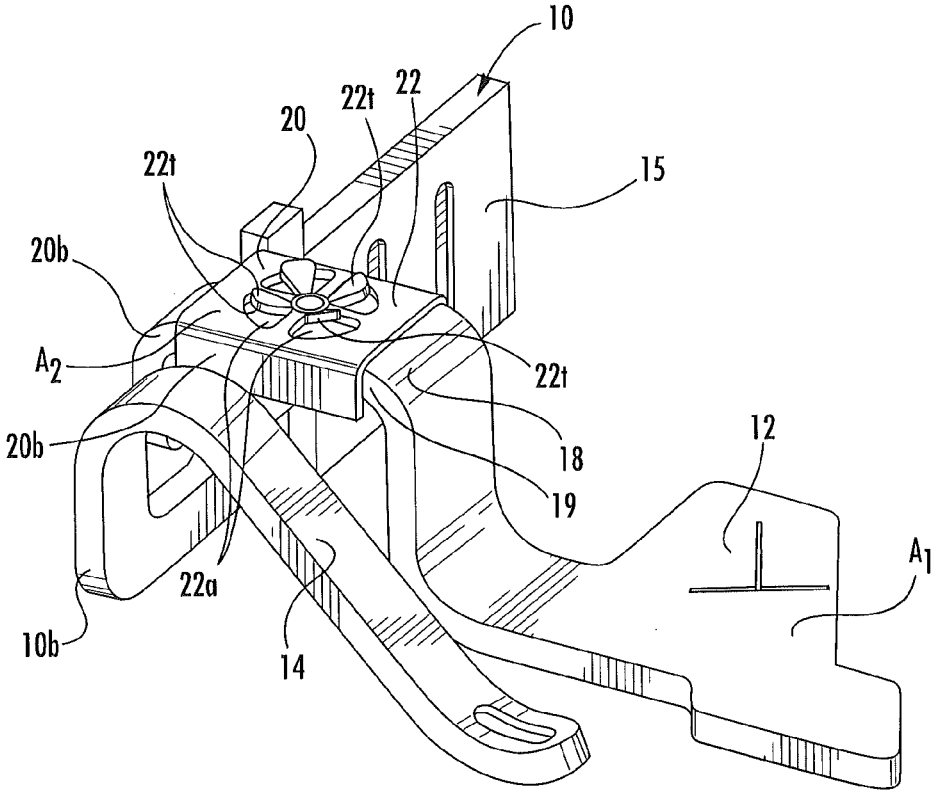
FIG. 4 is an enlarged side perspective view of another example of a new bus spring configuration according to embodiments of the present invention.
Figure 5:
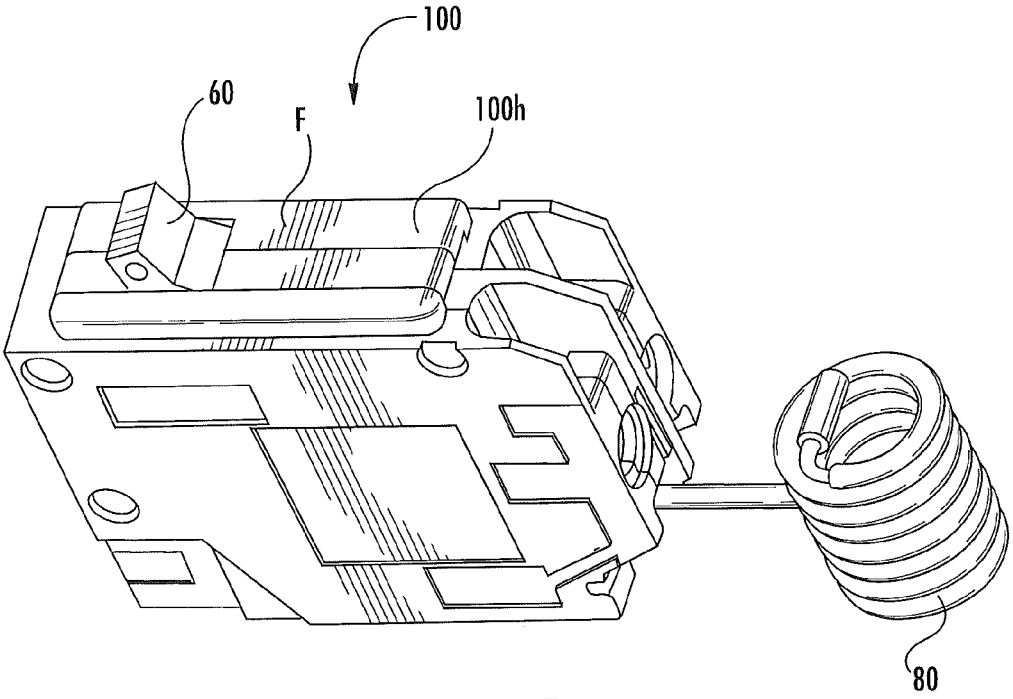
FIG. 5 is a side perspective view of an example of an assembled circuit breaker according to embodiments of the present invention.
Figure 6:
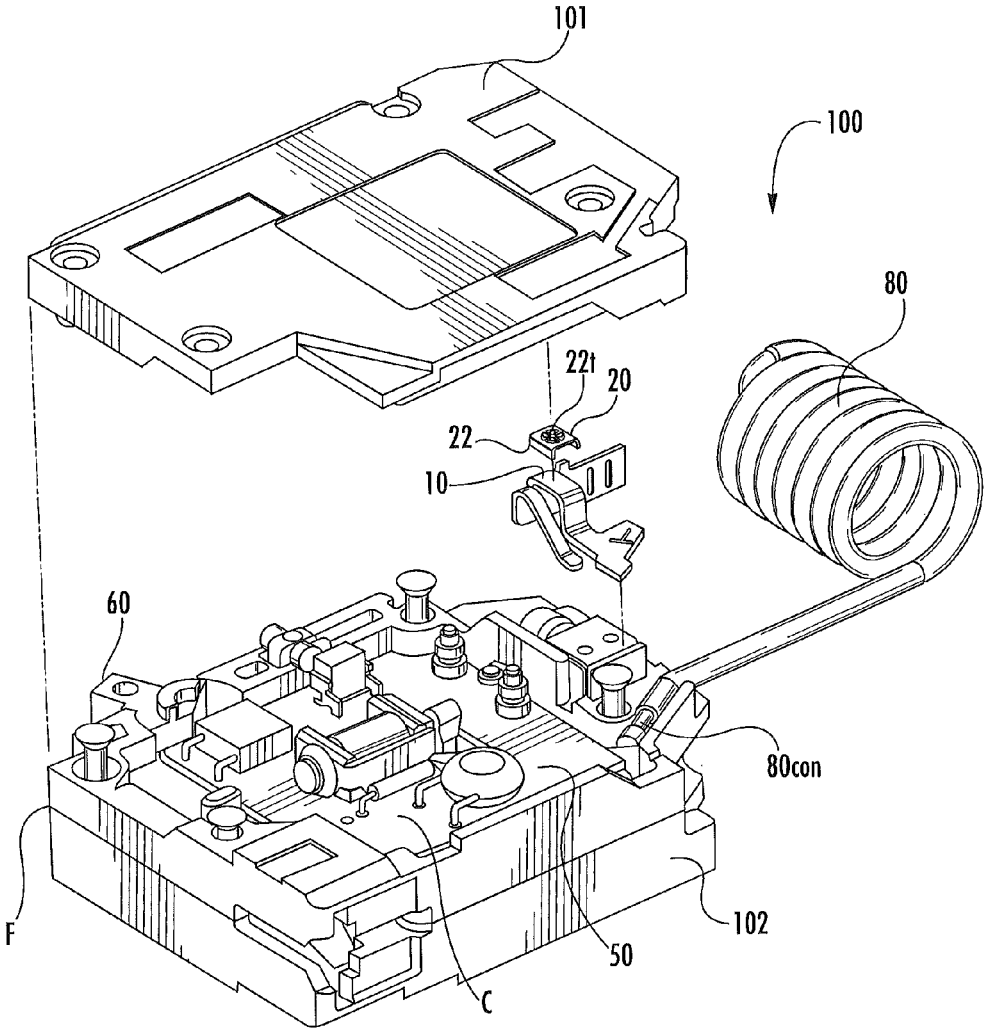
FIG. 6 is an exploded perspective view of the circuit breaker shown in FIG. 5 according to embodiments of the present invention.

FIGS. 2, 3 and 4 illustrate that the first energizing or bus spring 10/10' can have a spring body 10*b* with an arm 14 that provides a first displacement $D_1$. The first energizing spring body 10*b* can be a monolithic shaped body of electrically conductive material. The body 10*b* can also be formed as attached segments (not shown). The body 10*b* can comprise shaped electrically conductive sheet metal such as, but not limited to, brass. The body 10*b* of the first energizing spring 10/10' can also include an elongate segment 18 that is adjacent the arm 14 and has an upper surface 19 that can provide a direct or indirect electrical (bus) interface I with the bus input and that merges into a lower circuit board contact surface 12. The body 10*b* of the first energizing spring 10/10' can also include a back or support segment 15 that is typically orthogonal to and extending away from the arm 14 on the other side of the contact segment 18. The upper surface 19 can be configured to reside proximate to and under the first housing member 101 and the second surface 12 can be closer to and/or resides on the circuit board 50 (FIGS. 6, 8).

The use of at least one second energizing spring 20 that cooperates with the first (e.g., primary) energizing spring 10, which together can be described as a compound spring, can provide additional displacement for ensuring a desired contact force and each spring 10, 20 can be configured to operate within its stress levels to avoid set/fatigue.

By way of example only, and not limiting to embodiments of the claimed invention, in the past, in some particular designs, the spring arm 14 was configured to have deflection limits with a contact force with tolerances of a minimum of 0.020 inches and a maximum of 0.059 inches. Because of this, the piece part component tolerance limits were tight/small, which can result in higher component costs and lower yields. Using the second energizing spring 20, the lower limit on the arm 14 can be dropped to a lower value, such as to about 0.010 inches (half of the current requirement) or even lower, typically to about 0.005 inches, because contact force pressure can be maintained by the supplemental or second energizing spring 20. Again, different designs, materials, environments and the like (stress level, material composition, hardness, thermal, cycle, steady state operation) can vary the dimensions and the above is provided by way of example only.

The supplemental linear displacement provided by the secondary spring 20 may increase spring failures limits and/or desensitize loading variations during assembly due to component variability.

The contact surface 12 of the body 10*b* of the first spring 10/10' can have a larger surface area $A_1$ than the surface area $A_2$ of the upper surface 19 and/or the upper surface of the body of the secondary spring 20*b*. $A_1$ can be greater than $A_2$ by between about 1.5×-10×, for example. However, in some embodiments, the reverse configuration can be used where $A_2$ is $>A_1$.

FIG. 2 illustrates that the second (e.g., secondary) energizing spring 20 can comprise one or more leaf springs 20*l*. However, other spring configurations/geometries and/or types may be used as will be discussed by way of example below.

The second energizing spring 20 can be configured to deflect with a maximum linear displacement that is less than the maximum linear displacement provided by $D_1$ with $D_2$ typically being between about 5%-40%, more typically between 10-20%, of $D_1$, for example. In some embodiments, $D_1$ added to $D_2$ can provide an increase in total displacement of between about 5% to about 40%, more typically between about 10% to about 20%. These values are thought to be typical, but are provided by way of example and are not limiting to embodiments of the invention.

Figure 15A:
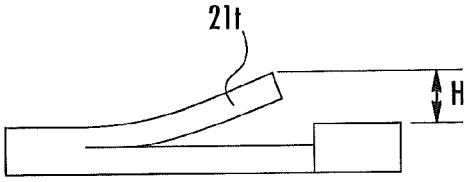
FIGS. 15A and 16A are schematic illustrations of examples of second energizing springs in an unloaded configuration according to embodiments of the present invention.
Figure 15B:
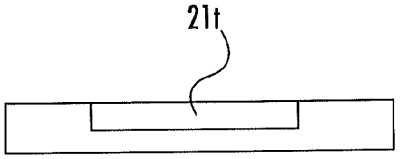
FIGS. 15B and 16B are schematic illustrations of the second energizing springs of FIGS. 15A and 16A, respectively, in a fully loaded configuration according to embodiments of the present invention.
Figure 16A:
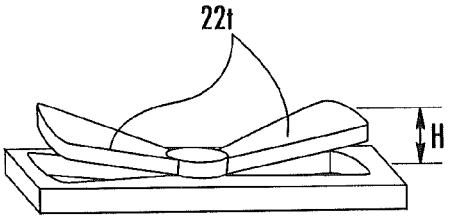

The second energizing spring 20 can be configured to have a controlled displacement so that the second energizing spring 20 deflects from an unloaded projecting state (FIGS. 15A, 16A) to a substantially or totally flat state (FIGS. 15B, 16B) at maximum loading, e.g., upon assembly in the housing 100*h* (FIG. 7) and/or when fully compressed so as to have a hard "stop" and therefore cannot be overstressed because it stops flexing in the substantially flat state. The controlled stop can be a physical stop provided by the geometry of the second energizing spring 20 and/or by a substrate holding or residing under the second spring 20. The second energizing spring 20 can be configured so that when fully compressed it deflects to a flat shape/state or to have slightly recessed configuration relative to the upper surface 19 of the first energizing/bus spring segment 18. The deflection amount from unloaded to fully loaded/fully compressed can be any suitable value.

Again, by way of example only, in some particular embodiments, the deflections can be between about 0.50 inches to about 0.001 inches, but the designs can be configured to provide other deflection values. The full compression/flat state can be configured to occur when fully compressed, loaded, e.g., which may be associated with when the at least one second energizing spring 20 is assembled inside the housing 100*h*, e.g., when the cover 101 of the housing is attached to the other housing member 102 (FIG. 6), the second spring 20 can deflect and/or compress to a substantially flat state, typically to be co-planar with the upper planar surface 19 of the primary spring segment 18.

FIG. 3 illustrates that the second energizing spring 20 can be an integral spring 20I with the bus spring 10 to provide a modified bus spring configuration 10'. That is, the second energizing spring 20 can be a formed semi-rigid and/or flexible feature of the monolithic shaped body 10*b* of the first (e.g., primary) energizing spring 10'. As shown, the second energizing spring 20 can be configured with at least one tab 21*t* (shown as a single tab) that rises above the surrounding portion of the spring body at the upper planar surface 19 of segment 18, typically adjacent the arm 14. The tab 21*t* can be separated from the adjacent solid surface 19 with a gap 21*g*. As also shown, there is a single tab 21*t* with the gap on three sides thereof with the tab extending off the other side of the planar upper surface 19 of the spring body segment 19. Although shown as a single tab, the energizing spring 20 may be configured with a plurality of longitudinally and/or laterally spaced apart tabs extending about the upper surface 19 of the spring segment 18. If a plurality of tabs 21*t* are used, they may have the same or different sizes and/or shapes. The at least one tab 21*t* can have a free end 21*e*. The free end 21*e* of the at least one tab 21*t* can deflect toward the circuit board 50 (FIG. 6) to be substantially or totally co-planar with the surface 19 of the first spring body 10*b* upon full compression and/or assembly.

FIG. 4 illustrates that the second energizing spring 20 can be a separate component 20S that may reside over and/or on the upper surface 19 of the first energizing spring 10 (at the bus interface I, FIGS. 8, 9), typically adjacent the arm 14. As shown, the energizing spring 20 can be provided as a cap or sleeve 22 with projecting tabs 22*t*. As shown, the tabs 22*t* (shown as four tabs) can be circumferentially spaced apart and project radially outward and upward from a common center, e.g., a center of the sleeve 22. The tabs 22*t* can be held over open apertures 22*a* allowing the free ends 22*e* of the tabs 22*t* to deflect into those apertures 22*a*, typically to a controlled depth or deflection/hard stop. The hard stop can be provided by the material of the spring/shape of the tabs or apertures and/or upon contact with a substrate under the apertures 22*a* (shown as the upper surface 19 of the first energizing spring 10). Also, a single tab 22*t* can be used rather than a plurality. If a plurality of tabs 22*t* are used then they can be regularly or irregularly spaced apart and may have the same or different shapes and sizes. Further, the tabs 22*t* can have other shapes and can be arranged in other configurations. The second energizing spring 20 when provided as a separate component can also have other deflectable spring designs. Optionally, the sleeve 22 is attached to the upper surface 18 of the first spring body 10*b* and oriented so that the at least one tab 22*t* faces the housing member 101 (which may be described as a cover).

The first energizing spring 10 can have an elongate segment 18 and the arm 14. The arm and elongate segment 14, 18 can reside adjacent and spaced apart and both can extend side-by-side in a common direction, e.g., each can extend outward toward a corner of the housing. The elongate segment 18 can have the first planar segment 19 that merges into the second planar segment 12. The second planar segment 12 can define the circuit board contact surface that contacts the circuit board 50, The second energizing spring 20 can have at least one tab 21*t*, 22*t* (for example), that extends above the first planar segment 19 in an unloaded configuration and can, in some embodiments, be substantially flat and coplanar with the first planar segment 19 in a fully compressed configuration.

FIGS. 5-8 illustrate an exemplary circuit breaker 100 with a housing 100*h* and a switch 60 which can be externally accessible, e.g., an externally accessible user input switch, The circuit breaker 100 can include an internal circuit board 50 holding components of a circuit C, The circuit C can be powered by an external source, e.g., via a conductor 80 and conductor connector 80*con* to an external power source, typically via a bus (not shown), through the first energizing spring 10/10'. The term "bus" refers to an external power source, typically comprising a conducting bus bar that carries currents to connect loads and sources of electric power in an electric power system.

The housing 100*h* can be held in any suitable orientation. In some use environments, it can be held with a front surface F (FIG. 5) being vertical (FIG. 6) but with the switch S facing forward to be accessible by a user. However, in other use environments, the housing 100*h* can be oriented in other ways. Thus, while the first surface or segment 19 of the spring segment 18 is described as the upper surface or segment 19, the relative positions can change if the orientation of the housing 100*h* is changed. Also, the housing 100*h* or the arrangement of the circuit board 50 in the housing 100*h* can be changed thereby moving the primary energizing spring 10 which can change the relative orientations.

The circuit breakers 100 may be held in "starter units" for supplying power controlling electrical motors and pumps or held in general "feeder units" for supplying feeder circuits. The term "unit" refers to a structure (typically having sides of a protective metal shell) that contains a circuit breaker for turning power ON and OFF to a motor, or feeder circuit. The unit can include other components such as a power transformer, a motor starter to control a single motor and PLCs (programmable logic controllers), drives and the like. As is well known, the unit can have a bus grid with "power stabs" in the back that connect to bus bars that carry power (current) to the compartments of a vertical section in a cabinet. The bus bars can be horizontal and can be connected to larger (typically horizontal) bus bars that bring power to vertical sections. The horizontal bus bars are usually in the top, but some MCC designs may have them in the center or bottom.

Figure 7:
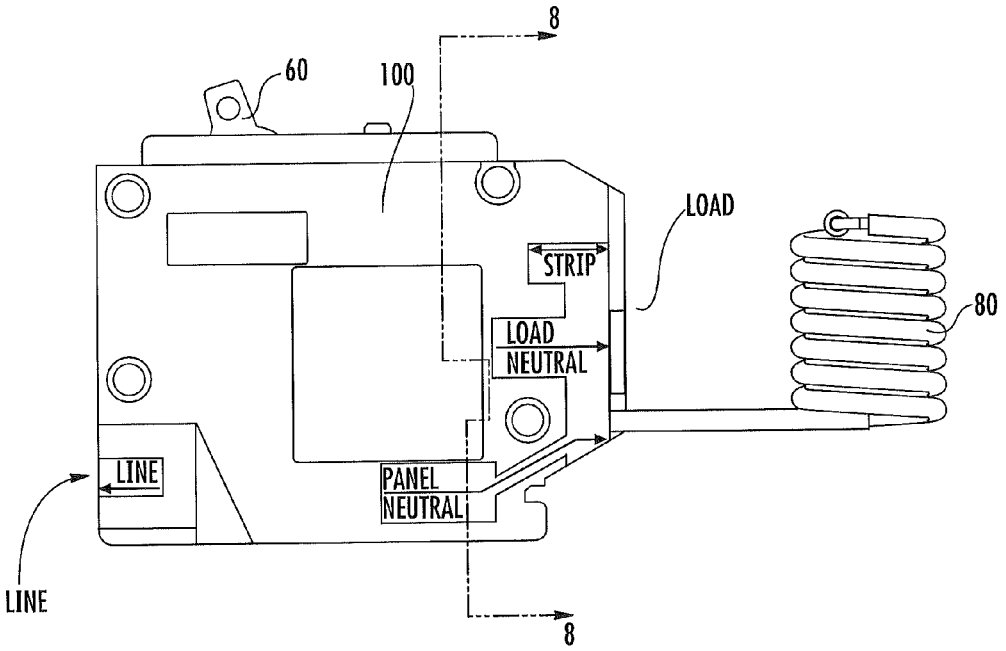
FIG. 7 is a side view of the circuit breaker shown in FIG. 5.

As is well known, the circuit breaker 100 can have a "load side" (designated as "Load" in FIG. 7), which refers to the side connected to the load and a "line side" (designated as "Line" in FIG. 7).

The circuit breaker 100 can be configured as a "molded case circuit breaker" or "MCCB" which is a device designed to open and close a circuit, typically allowing both manual open and close operation and automatic circuit interruption, the latter to open a circuit under certain conditions, e.g., an over-current. The circuit breaker 100 may be particularly suitable for residential purposes but may also be suitable for commercial and industrial uses.

FIG. 6 illustrates that the first (e.g., primary) energizing spring 10/10' can be held in a corner of the circuit board 50 proximate the conductor connector 80*con* so that the base segment 12 resides directly on the circuit board 50. However, the spring 10/10' can be placed in other locations, depending on the layout of the board 50 and input, for example.

Figure 16B:
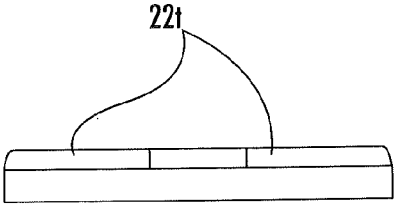

FIGS. 8 and 9 illustrate the cover 101 relative to the spring 10/10' when the cover is over but not fully seated against the housing member 102. The spring arm 14 can deflect inward upon assembly, as can the second energizing spring 20. In the embodiment shown in FIGS. 8 and 9, assembly beyond this point can flex the spring arm 14 and tabs 22*t* (FIG. 4) to deflect inward to take on a substantially flat state (FIG. 16B). The gap spacing X (FIG. 8) before compression occurs to move the flex or deflect the secondary spring 20 can correspond to the unloaded projection height "H" (FIG. 9) of the at least one energizing spring 20, e.g., the height of the free end of the tab 21*t*, 22*t* (FIGS. 15A, 16A), where those geometries are used. In some particular embodiments, the gap spacing X can be between about 0.010 inches to about 0.001 inches, but other values may be used for different designs and configurations.

Figure 10A:
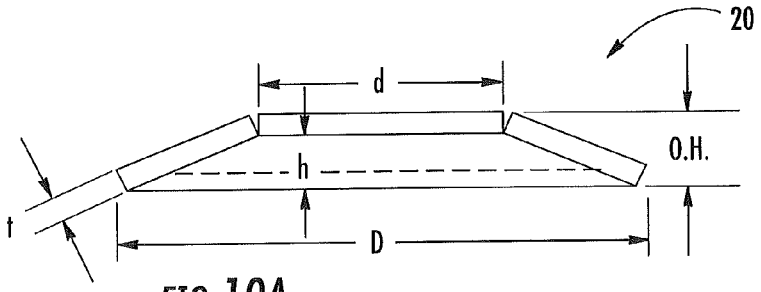
FIG. 10A is a section view of an exemplary dome washer that may be used for the second energizing spring configuration according to embodiments of the present invention.
Figure 10B:
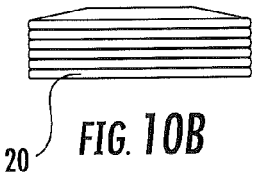
FIGS. 10B-10D are side views of exemplary stacked dome washers that may be used for the second energizing spring configuration according to embodiments of the present invention.
Figure 10C:
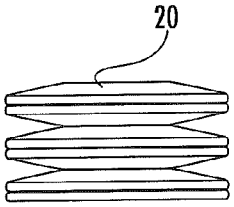
Figure 10D:
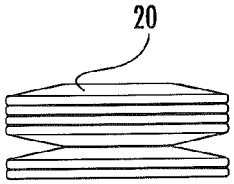
Figure 11:
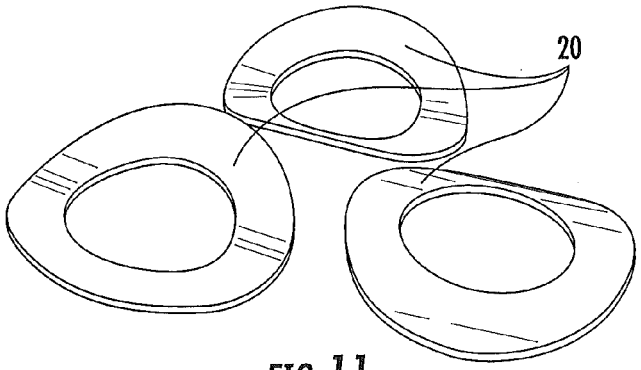
FIG. 11 is a top perspective view of curve or wave washers that may be used for the second energizing spring configuration according to embodiments of the present invention.
Figure 12:
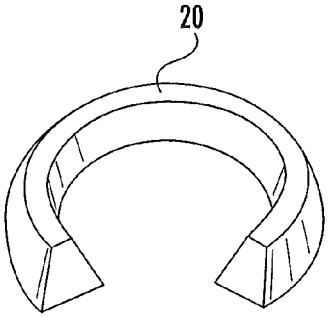
FIG. 12 is a side perspective view of a coil spring spacer that may be used for the second energizing spring configuration according to embodiments of the present invention.
Figure 13:
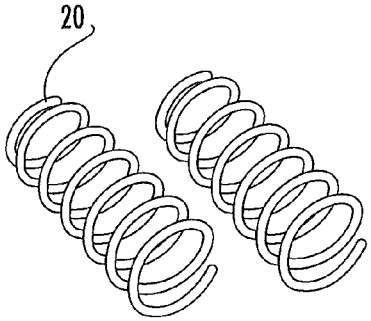
FIG. 13 is a side perspective view of coil springs, one or more of which may be used for the second energizing spring configuration according to embodiments of the present invention.

FIGS. 10A-10C, 11, 12 and 13 illustrate examples of other spring configurations that may be used for the at least one second energizing spring 20. FIG. 10A is a section view of a single dome spring washer, e.g., a Belleville or Clover®Dome spring washer, see U.S. Pat. No. 6,705,813 for the latter, the contents of which are hereby incorporated by reference as if recited in full herein, FIGS. 10B-10D illustrate examples of stacked spring washers (parallel, series, and parallel-series, respectively). FIG. 11 illustrates wave or curved washers can be used for the second energizing spring 20. FIG. 12 illustrates a coil spring spacer that may be used for the second energizing spring 20. FIG. 13 illustrates one or more coil springs that can be used for the second energizing spring 20.

It is also contemplated that a conductive polymeric semi-rigid or flexible plug, O-ring or other structure may be used as the second energizing spring 20. Combinations of these and embodiments such as those discussed above and/or other spring configurations may be used.

Figure 14A:
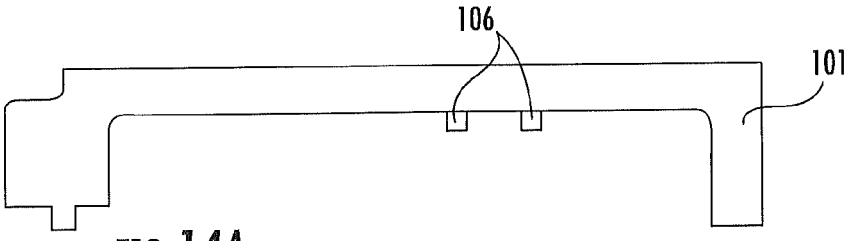
FIG. 14A is a side section view of an exemplary housing cover that can include alignment members for the second energizing spring according to embodiments of the present invention.

In some embodiments, the second energizing spring 20 can be held apart from the first energizing spring 10 and held on the surface 19 upon assembly of the housing members 101, 102. FIG. 14A illustrates that the first housing member 101 (e.g., cover) can include alignment and/or retainer members 106 to hold one or more second energizing springs 20 in position over the spring segment 19. Thus, the alignment and/or retainer members 106 can extend inward to align with and reside over the upper surface 18 of the first bus spring segment 19.

Figure 14B:
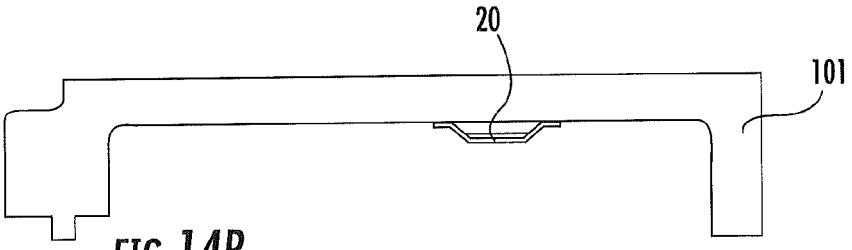
FIG. 14B illustrates that the second energizing spring can be attached to the housing cover according to embodiments of the present invention.

FIG. 14B illustrates that the second energizing spring 20 may be attached to the first housing member 101 (e.g., cover) prior to attachment of the first housing 101 to the second housing 102 for ease of assembly.

FIGS. 15A, 15B, 16A, 16B illustrate the controlled deflection of the second energizing spring 20 according to embodiments of the present invention. As shown, the second energizing spring 20 can take on a substantially (or totally) flat shape when fully compressed so that the spring 20 cannot be over stressed in position in the housing 100*h*. It is also noted that the spring 20 may deflect inward to angle down past the flat state in some embodiments, but still have a controlled stop based on an underlying substrate or configuration of the spring to have a desired hard stop. In some embodiments, the tab 21*t*, 22*t* can be recessed into or extend below the aperture 21*g*, 22*a* (FIGS. 3, 4).

The first energizing spring 10, 10' and the at least one second energizing spring 20 can be electrically conductive and may be metallic, electrically conductive polymeric or other suitable electrically conductive material, or combinations of electrically conductive materials.

The at least one second energizing spring 20 can have a flexible non-conductive substrate with a conductive outer coating or film. The second energizing spring 20 can comprise a resilient conductive polymeric material (e.g., electro active polymeric materials). See, e.g., U.S. Pat. No. 7,466,154, entitled "Conductive Particle Filled Polymer Electrical Contact" and Shirakawa et al., Synthesis of Electrically Conducting Organic Polymers: Halogen Derivatives of Polacetylene, (CH)x, J. C. S. Chem. Comm. 1977, 578-580, the contents of which are hereby incorporated by reference as if recited in full herein.

In some embodiments, the first energizing spring body 10*b* and the second energizing spring 20 are formed of a conductive metal such as, but not limited to brass, for example, and are typically formed of the same metal, and the metal can be a non-ferromagnetic metal.

Where the second energizing springs 20 are separate components 20S they can comprise the same or different electrically conductive material as the primary energizing spring 10.

Although described for use with circuit breakers, the energizing springs 10/10' may also be suitable for other circuits and devices with circuits.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A circuit breaker, comprising:

a housing;

a circuit board in the housing;

a first bus energizing spring held in the housing that electrically connects the circuit board to an external electrical connection, the first bus energizing spring is configured to deflect toward the circuit board with a first linear displacement; and a second bus energizing spring held in the housing with at least a portion extending over and in cooperating alignment with the first bus energizing spring and is configured to deflect toward the circuit board with a second linear displacement to thereby provide a linear displacement capability as a summation of the first and second linear displacements, wherein the second bus energizing spring has an unloaded configuration and a fully compressed configuration, and wherein, when in the fully compressed configuration, the second bus energizing spring has a substantially flat configuration.

2. The circuit breaker of claim 1, wherein the second linear displacement is a controlled displacement so that the second energizing spring ceases deflection at a flat state to provide the substantially flat configuration whereby the second energizing spring cannot be over stressed.

3. The circuit breaker of claim 1, wherein the second bus energizing spring is integral to the first bus energizing spring.

4. The circuit breaker of claim 1, wherein the second bus energizing spring is a discrete component separate from the first bus energizing spring.

5. The circuit breaker of claim 1, wherein the first bus energizing spring has an elongate segment that resides adjacent and spaced apart from an arm, wherein the elongate segment has a first planar segment that merges into a second planar segment, the second planar segment defining a circuit board contact surface that contacts the circuit board, and wherein the first planar segment comprises, holds, and/or is in aligned contact with the second bus energizing spring.

6. The circuit breaker of claim 1, wherein the housing comprises a first housing member and a second housing member that attach together, wherein the second housing member holds the circuit board, and wherein the second bus energizing spring resides adjacent the first housing member and is integral to the first bus energizing spring.

7. A circuit breaker, comprising:

a housing;

a circuit board in the housing;

a first bus energizing spring held in the housing that electrically connects the circuit board to an external electrical connection, the first bus energizing spring is configured to deflect toward the circuit board with a first linear displacement; and a second bus energizing spring held in the housing in cooperating alignment with the first bus energizing spring and is configured to deflect toward the circuit board with a second linear displacement to thereby provide a linear displacement capability as a summation of the first and second linear displacements, wherein the second linear displacement is less than the first linear displacement.

8. A circuit breaker, comprising:

a housing;

a circuit board in the housing;

a first bus energizing spring held in the housing that electrically connects the circuit board to an external electrical connection, the first bus energizing spring is configured to deflect toward the circuit board with a first linear displacement; and a second bus energizing spring held in the housing in cooperating alignment with the first bus energizing spring and is configured to deflect toward the circuit board with a second linear displacement to thereby provide a linear displacement capability as a summation of the first and second linear displacements, wherein the first bus energizing spring has an elongate segment and an arm that resides adjacent and spaced apart from the elongate segment, wherein the elongate segment has a first planar segment that merges into a second planar segment, the second planar segment defining a circuit board contact surface that contacts the circuit board, wherein the second bus energizing spring has at least one tab that extends above the first planar segment in an unloaded configuration and is substantially flat and coplanar with the first planar segment in a fully compressed configuration.

9. The circuit breaker of claim 8, wherein the second energizing spring comprises a sleeve with a plurality of spaced apart tabs that deflect into respective receiving apertures, and wherein the sleeve is held on the first planar segment.

10. The circuit breaker of claim 8, wherein the first planar segment comprises a single tab with a free end surrounded on three sides by a gap space that defines the bus secondary energizing spring.

11. A circuit breaker, comprising:

a housing;

a circuit board in the housing;

a first bus energizing spring held in the housing that electrically connects the circuit board to an external electrical connection, the first bus energizing spring is configured to deflect toward the circuit board with a first linear displacement; and a second bus energizing spring held in the housing in cooperating alignment with the first bus energizing spring and is configured to deflect toward the circuit board with a second linear displacement to thereby provide a linear displacement capability as a summation of the first and second linear displacements, wherein the housing comprises a first housing member and a second housing member that attach together, wherein the second housing member holds the circuit board, and wherein the second bus energizing spring resides adjacent the first housing member in abutting contact with the first bus energizing spring and electrically connects the first bus energizing spring to the external electrical connection.

12. A circuit breaker, comprising:

a housing;

a circuit board in the housing;

a first bus energizing spring held in the housing that electrically connects the circuit board to an external electrical connection, the first bus energizing spring is configured to deflect toward the circuit board with a first linear displacement; and a second bus energizing spring held in the housing with at least a portion extending over and in cooperating alignment with the first bus energizing spring and is configured to deflect toward the circuit board with a second linear displacement to thereby provide a linear displacement capability as a summation of the first and second linear displacements, wherein the housing comprises a first housing member and a second housing member that attach together, wherein the second housing member holds the circuit board, and wherein the second bus energizing spring resides adjacent the first housing member and can compress to a flat configuration at full loading due to contact with the first housing member when the first and second housing members are attached.

13. A circuit breaker, comprising:

a housing;

a circuit board in the housing;

a first bus energizing spring held in the housing that electrically connects the circuit board to an external electrical connection, the first bus energizing spring is configured to deflect toward the circuit board with a first linear displacement; and a second bus energizing spring held in the housing with at least a portion extending over and in cooperating alignment with the first bus energizing spring and is configured to deflect toward the circuit board with a second linear displacement to thereby provide a linear displacement capability as a summation of the first and second linear displacements, wherein the second bus energizing spring is in abutting contact with the first bus energizing spring and electrically connects the first bus energizing spring to the external electrical connection.

14. A device with a circuit, comprising:

a housing comprising a first housing member attached to a second housing member;

a circuit board in the housing;

a first energizing spring held in the housing that electrically connects the circuit board to an external electrical connection, the first energizing spring is configured to deflect toward the circuit board, wherein the first energizing spring has an elongate segment and an arm that resides adjacent and spaced apart from the elongate segment, wherein the elongate segment has a first planar segment that merges into a second planar segment, the second planar segment residing against the circuit board; and a second energizing spring held in the housing, wherein the second energizing spring extends above the first planar segment in an unloaded configuration and is substantially flat and coplanar with the first planar segment in a fully compressed configuration.

15. The device of claim 14, wherein the first energizing spring is configured to deflect toward the circuit board with a first linear displacement, and wherein the second energizing spring is configured to deflect toward the circuit board with a second linear displacement that is less than the first linear displacement.

16. An energizing spring for a device with a circuit, comprising:

a first conductive energizing spring comprising an elongate segment and an arm, wherein the elongate segment and the arm reside adjacent and spaced apart from each other, wherein the elongate segment has an upper planar segment that merges into a lower planar segment; and a second conductive energizing spring that contacts the planar upper surface of or that resides over an aperture in the planar upper surface and that is configured to deflect downward to a substantially flat configuration upon full compression.

17. The energizing spring of claim 16, wherein the first conductive energizing spring comprises a back segment holding the arm and elongate segment and the arm, and wherein the elongate segment and the arm extend orthogonally outward from the back segment.

18. The energizing spring of claim 16, wherein the first conductive energizing spring is a monolithic shaped metallic body and the second conductive energizing spring comprises at least one projecting tab that can deflect down to the substantially flat configuration to be coplanar with the planar upper segment.

19. The energizing spring of claim 16, wherein the second conductive energizing spring is attached to the planar upper segment.

* * * * *